US005433414A

United States Patent [19]

Vieira

[11] Patent Number: 5,433,414

[45] Date of Patent: Jul. 18, 1995

[54] SPEAKER MOUNTING SYSTEM

[76] Inventor: Richard S. Vieira, P.O. Box 2177, Beaverton, Oreg. 97075

[21] Appl. No.: 98,811

[22] Filed: Jul. 29, 1993

[51] Int. Cl.[6] ..... A47F 5/00

[52] U.S. Cl. ..... 248/316.4; 248/632; 248/300; 248/638

[58] Field of Search ..... 248/316.4, 616, 924, 248/922, 923, 919, 917, 309.1, 295.1, 300, 670, 323, 490, 27.1, 632, 634, 638; 312/7.1; 381/188; 267/201, 292, 153, 140

[56] References Cited

U.S. PATENT DOCUMENTS

| | | | |
|---|---|---|---|
| 2,208,860 | 7/1940 | Smart | 248/490 X |
| 2,905,412 | 9/1959 | Kipp | 248/490 |
| 2,986,366 | 5/1961 | Wesson | 248/924 X |
| 3,112,968 | 12/1963 | Cotton et al. | 312/7.1 X |
| 3,911,221 | 10/1975 | Wong | 381/188 |
| 3,964,612 | 6/1976 | Skilliter, Jr. et al. | 248/309.1 X |
| 4,037,815 | 7/1977 | DeLano | 248/316.4 X |
| 4,074,883 | 2/1978 | Daly . | |
| 4,101,109 | 7/1978 | Edwards | 248/317 |
| 4,384,174 | 5/1983 | Suzuki et al. | 381/188 X |
| 4,417,714 | 11/1983 | Charm | 248/323 |
| 5,160,104 | 11/1992 | Sher | 248/295.1 X |
| 5,169,114 | 12/1992 | O'Neill | 248/316.4 X |
| 5,179,367 | 1/1993 | Shimizu | 248/922 X |
| 5,255,884 | 10/1993 | O'Neill | 248/329 |

FOREIGN PATENT DOCUMENTS

| | | | |
|---|---|---|---|
| 0012794 | 1/1989 | Japan | 381/188 |

*Primary Examiner*—Karen J. Chotkowski

[57] ABSTRACT

A bracket for vertically mounting an object to various structural supports such as a wall, a vertical beam or a floor stand. The device comprises two rigid "L" shaped brackets mounted in opposing fashion which clamp the object using vertical tension applied by the resiliency of both steel and rubber.

2 Claims, 5 Drawing Sheets

SPEAKER MOUNTING SYSTEM

BACKGROUND OF THE INVENTION

The invention relates to mounting brackets for home audio speakers and the like, and more particularly to a mounting bracket that allows a speaker to be pivotally engaged and disengaged quickly and easily without marring the speaker, and is adjustable to hold many sizes of speakers.

It is well known that the performance of high fidelity speaker systems can be greatly affected by the placement and orientation of the speaker cabinets. The growing popularity of satelite/subwoofer systems and surround-sound systems has flooded the market with smaller speakers and increased the need for wall and stand mounting systems.

Methods of installing high fidelity speakers off the floor generally use such hardware components as hooks, hangers, wire, or metal struts which must be attached to the speaker cabinet, by nails, screws or bolts. The result is a damaged speaker cabinet and possible damage to the performance of the speaker, and/or loss of pivotal orientation versatility.

SUMMARY OF THE INVENTION

The present invention provides a device to mount a speaker cabinet off the floor, with proper orientation, without injury to the cabinet, and allows for easy removal of the speaker cabinet.

The device comprises two steel flat bars bent to approximately 90 degrees, a flat rubber pad, a dense rubber ball or the like, and a small portion of flat bar. The "L" shaped bars are mounted in opposing fashion (FIG. 1) forming a substantially "U" shaped speaker bracket having base arm members 1*b*, 2*b* or 9*b* mounting a pair of outwardly projecting, spaced apart arms 1*a*, 2*a*, 9*a*, 9*c* between which a speaker may be freely received, and the rubber pad is mounted to the top of the toe on the lower "L" shaped bracket. The small piece of flat bar is used as a shim if the configuration requires. The speaker cabinet is placed and centered on the rubber pad which is attached to the lower "L" shaped bar. The rubber ball is then wedged in between the upper "L" shaped bar and the speaker. A hole is bored into the upper "L" shaped bar to act as a seat for the ball.

There are four advantages of the speaker mounting device: the ability to pivot the cabinet within, the ease of engagement and disengagement, the versatility in the cabinet size it will hold, and the most important of all, this bracket does not, in any way, damage the cabinet.

DESCRIPTION OF THE PREFERRED EMBODIMENTS

Figure 1:
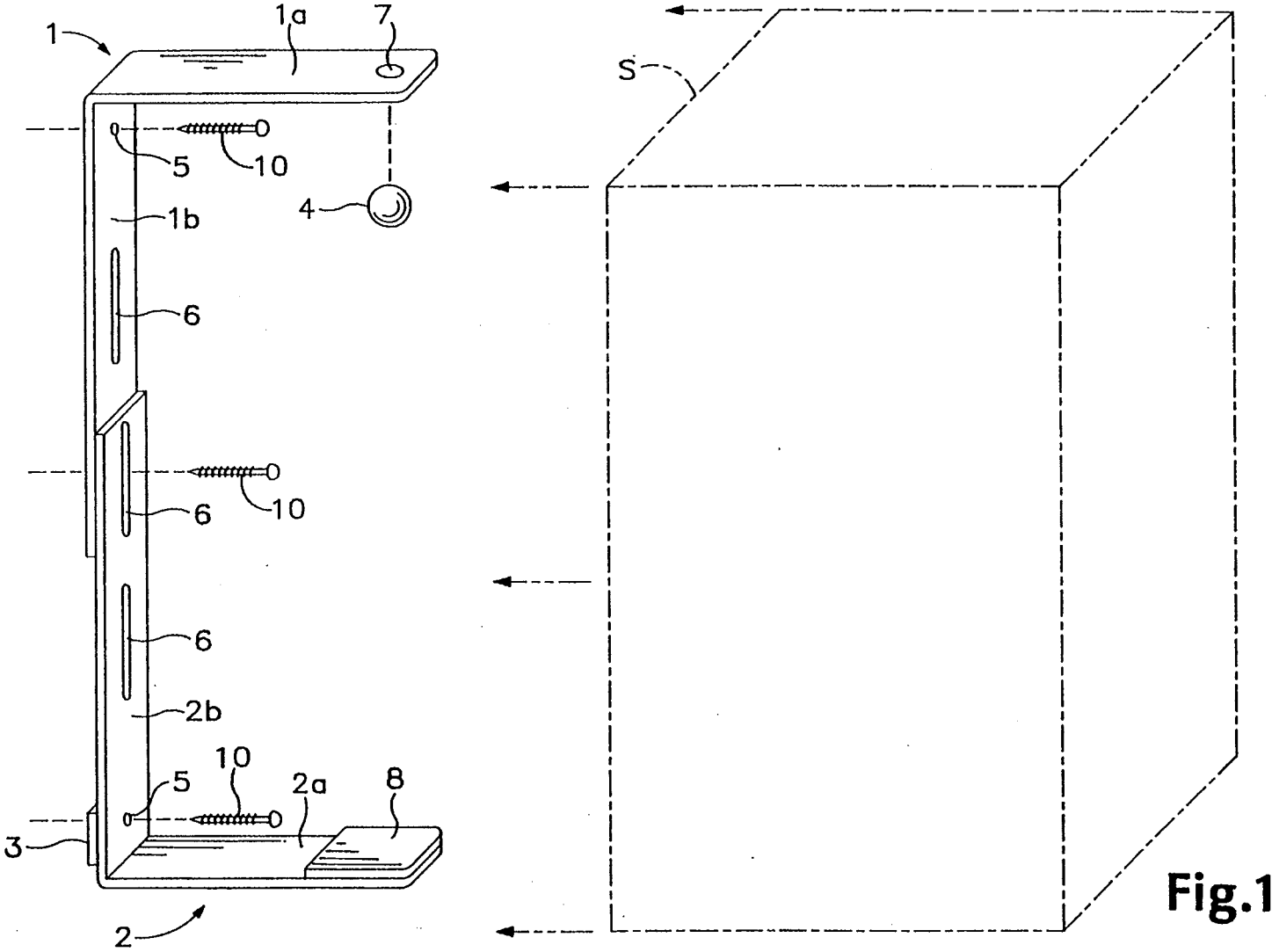
FIG. 1 is a perspective view of the bracket with a speaker cabinet outlined and ready for engagement.

Referring to FIG. 1, this embodiment of the invention illustrates an adjustable mounting bracket for supporting speakers of different sizes and consists of four distinct parts aside from the screws used to mount the device to a structural support. A first bracket member 1 is a length of steel flat bar bent to between 88 degrees and 90 degrees, forming outwardly projecting arm 1*a* and base arm member 1*b*. Two adjustment slots 6 are bored near the end of arm 1B to accommodate differing sizes of speakers. Adjacent the bend, on arm 1*b*, bore 5 is provided to accommodate mounting screw 10 for securing the bracket member to a wall. A second bore 7 is provided in arm 1*a* to act as a seat for a ball, member 4, formed of a compressible, resilient material such as rubber or the like. Ball 4 is approximately twice the diameter of bore 7. All the bores are centered along the width of the bracket member 1.

Referring to FIG. 1, a second bracket member 2 similar to the first bracket member 1, and having outwardly-projecting arm 2*a* and base arm member 2*b*, includes corresponding bores and slots labeled 5 and 6 respectively. Bracket member 2, however, instead of providing bore 7, mounts a frictional pad member 8, made of sheet rubber or the like, on the upper toe of arm 2*a*.

Referring to FIG. 1, member 3 is a very short length of steel flat bar the same thickness and width as bracket members 1 and 2. A bore is centered in member 3 to accommodate screw 10 used to mount bracket members 2 and 3 to a wall succinctly. Member 3 is a shim used to support member 2 away from the wall.

Referring to FIG. 1, "S" is the outline of a speaker ready for engagement.

Figure 2A:
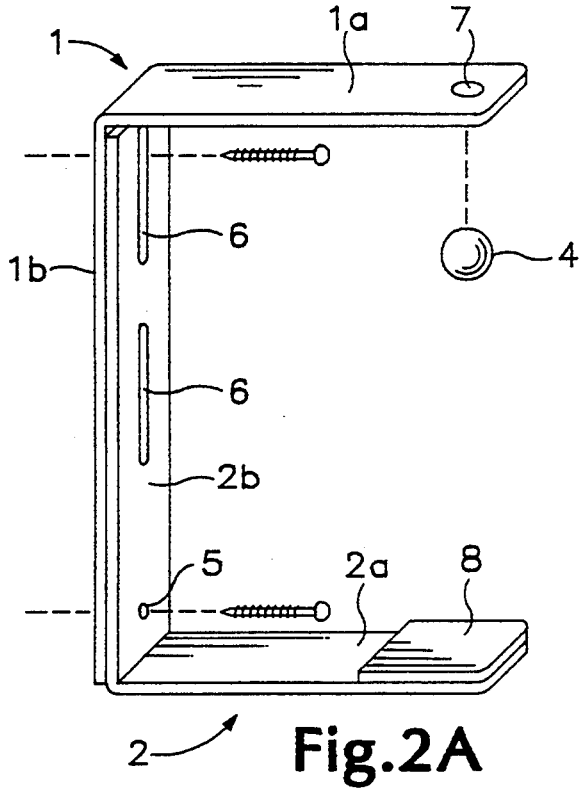
FIGS. 2A, 2B, and 2C are perspective views of the components of the bracket displayed in three different mounting arrangements respectively.
Figure 2B:
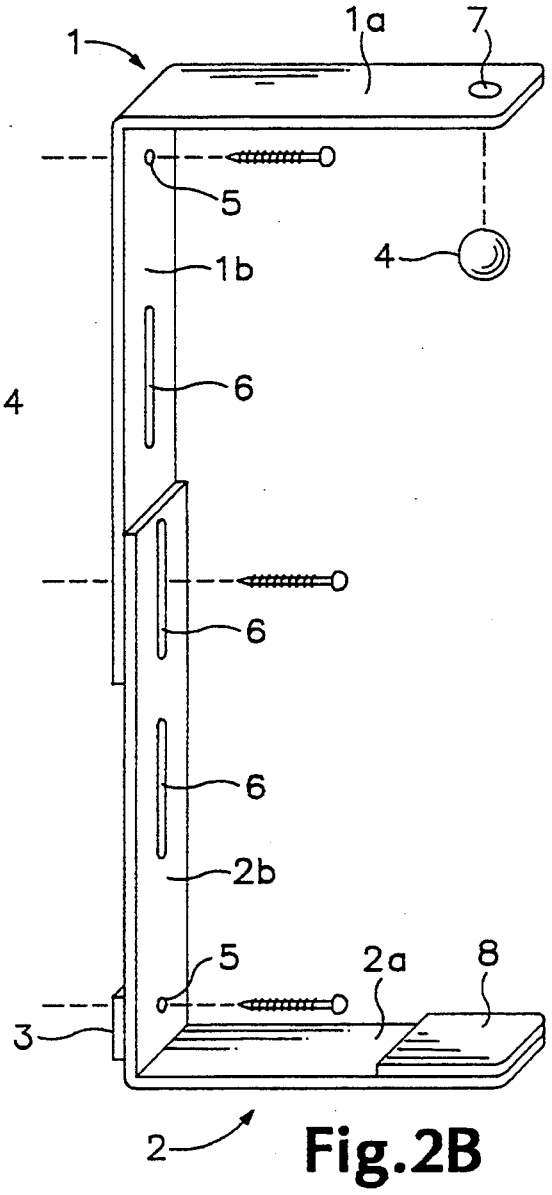
Figure 2C:
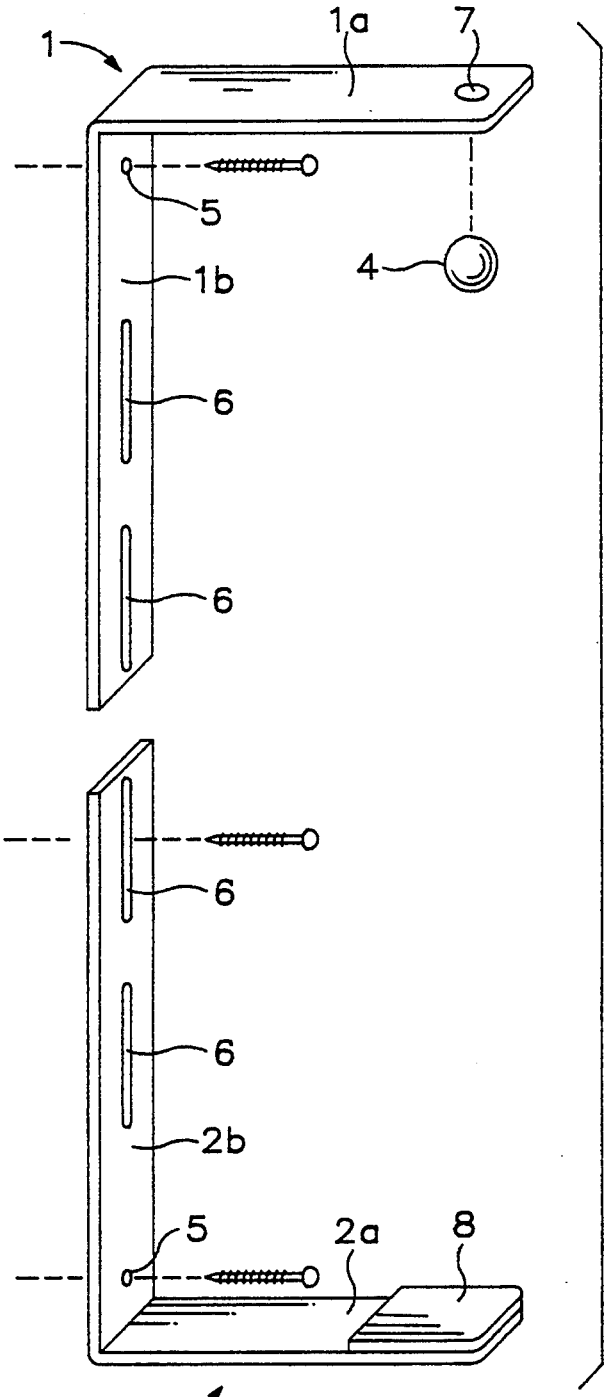

FIGS. 2A, 2B and 2C depict the three methods of wall mounting the invention depending upon the height of the speaker cabinet.

Figure 3A:
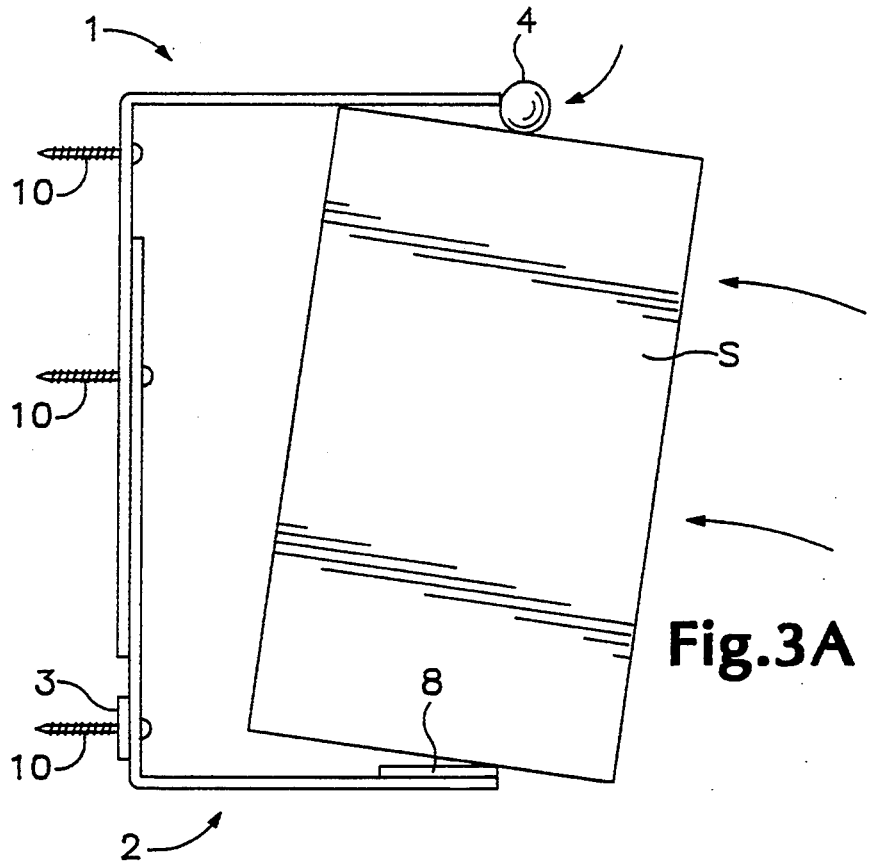
FIGS. 3A and 3b are side elevation views of a wall mounted bracket during engagement of a speaker.
Figure 3B:
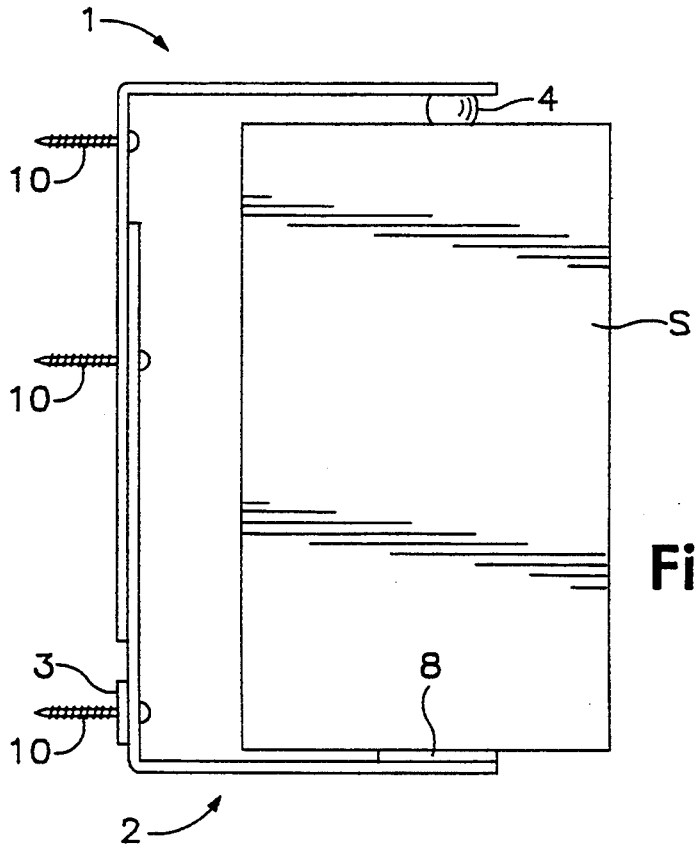
Figure 4:
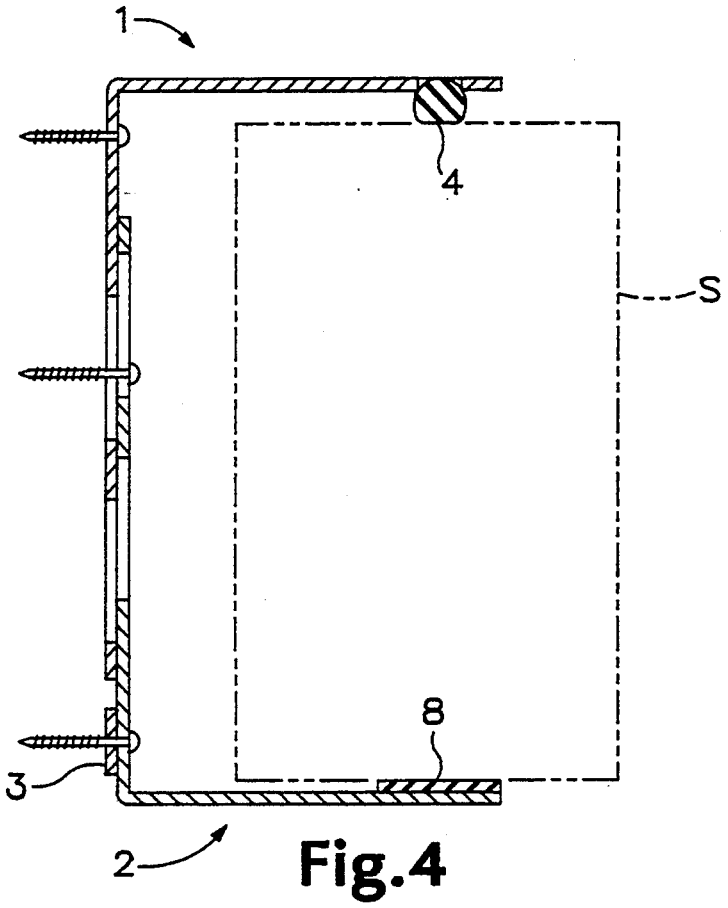
FIG. 4 is a cross-sectional view of a wall mounted bracket supporting a speaker.

Referring to FIG. 2A, if the height of the speaker cabinet is less than the length of base arm 1B plus the height of member 3 (remembering that the width of 3 is equal to the width of members 1 and 2), then member 3 will not be needed during the assembly. To install the invention, vertically mount bracket member 1 to a structural support using screw 10 inserted through bore 5 such that the adjustment slots 6 are directly below bore 5. Inversely affix bracket member 2 on top of bracket member 1 inserting a screw 10 through the aligned adjustment slots 6 of members 1 and 2 respectively. Insert a third screw 10 into bore 5 of bracket member 2 and one of the adjustment slots 6 in member 1. Resting a speaker on pad 8, the distance between the top of the speaker and the end of arm la should be approximately ¾ the thickness of the ball 4. Now tilt the speaker forward and wedge the ball, member 4, between arm 1*a* and the speaker and tilt the speaker back, forcing the ball 4 to rest in bore 7 (as shown in FIG. 3A and FIG. 3B). The speaker is thus held in place by the resilient tension of the bracket, ball and pad, and is contacted only by the ball at one of its ends and the pad at its opposite end. Therefore, while the speaker may be manually pivoted in order to point it in a desired direction, the friction pad also serves to provide a frictional surface which prevents undesired pivoting, sliding and vibrational movement of the speaker cabinet during use.

Referring to FIG. 2B, if the height of the speaker cabinet is greater than that described in the previous paragraph and less than the combined lengths of both arms 1*b* and 2*b*, then member 3 will be used in the assembly. To install, mount member 1 as previously described, then invert member 2 and mount it on top of member 1 inserting screw 10 through aligned adjustment slots 6 provided in both base arm members 1*b* and 2*b*. If adjustment slots 6 do not mesh, then install one screw 10 into one slot 6 in arm 1*b* and one screw 10 into one slot 6 in arm 2*b*. Next install a final screw 10 into bore 5 in arm 2*b*, passing through bore 5 of member 3, securing it into the wall such that member 3 is in between arm 2*b* and the wall. Place the speaker on the friction pad 8 and wedge ball 4 into place as outlined in previous paragraph.

Referring to FIG. 2C, if the speaker cabinet is taller than that described in both previous paragraphs, then member 3 is not to be used. Simply mount member 1, as described before, and secure a second screw 10 into one of the adjustment slots 6. Invert member 2 and mount it to the structural support in direct alignment with unit 1, inserting two screws 10 into the bore 5 and one adjustment slot 6 respectively. Place the speaker on friction pad and wedge ball into place as outlined in the previous paragraph.

Figure 5:
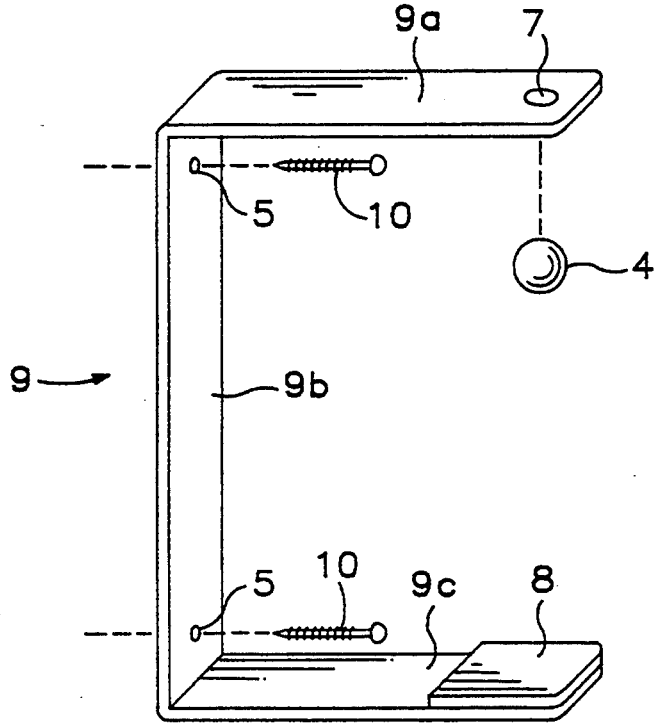
FIG. 5 is a perspective view of an alternative, non-adjustable bracket.

An alternate and simpler embodiment of the present invention is illustrated in FIG. 5. This is the non-adjustable version to be built for singular application with respect to speaker cabinet size. Speaker bracket 9 is simply a piece of flat bar steel bent to approximately 90 degrees in two different places, forming the "U" shaped speaker bracket provided by the two bracket members 1, 2 in the previous embodiment. The the distance between arms 9*a* and 9*b* is approximately equal to the height of the speaker plus $\frac{3}{4}$ the thickness of ball 4. Two bores 5, located on 9*b* adjacent each bend, house screws 10 which secure member 9 to a structural support. Bore 7, provided on arm 9*a*, is a seat for ball 4 and is approximately $\frac{1}{2}$ the diameter of ball 4. Install the speaker and ball 4 as outlined in the previous paragraphs.

I claim:

1. A speaker mounting assembly for mounting speaker cabinets and the like pivotally to walls and other structural supports, the speaker mounting assembly comprising:

a) a substantially "U" shaped mounting bracket configured with a base arm member arranged for attachment to a structural support, said base arm member mounting a pair of outwardly-projecting arms spaced apart sufficiently to receive between them a speaker cabinet to be mounted, b) a friction pad member mounted on one of said arms and facing the other arm of the pair, the pad member configured to releasably engage a speaker cabinet frictionally to restrict free relative movement of a speaker thereagainst and to prevent marring of a speaker cabinet supported by the arm, the other arm of the pair mounting seating means for releasably engaging and seating a spherical ball member, and c) a resilient, spherical ball member configured for wedged insertion between said other arm and a speaker cabinet received between the pair of arms, the ball member configured to engage said seating means and a speaker cabinet under tensioned engagement sufficient to securely support the speaker between the spherical ball member and the friction pad.

2. The speaker mounting assembly of claim 1 wherein said base arm member of the "U" shaped mounting bracket is configured for attachment to a supporting structure for adjustment of the distance between the outwardly-projecting, spaced apart pair of arms mounted thereto in order to accommodate mounting different size speaker cabinets therebetween.

* * * * *